US007624022B2

(12) United States Patent
Son et al.

(10) Patent No.: US 7,624,022 B2
(45) Date of Patent: Nov. 24, 2009

(54) SPEECH COMPRESSION AND DECOMPRESSION APPARATUSES AND METHODS PROVIDING SCALABLE BANDWIDTH STRUCTURE

(75) Inventors: Chang-yong Son, Seoul (KR); Ho-chong Park, Gyeonggi-do (KR); Yong-beom Lee, Gyeonggi-do (KR); Woo-suk Lee, Seoul (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 1018 days.

(21) Appl. No.: 10/882,339

(22) Filed: Jul. 2, 2004

(65) Prior Publication Data

US 2005/0004794 A1 Jan. 6, 2005

(30) Foreign Application Priority Data

Jul. 3, 2003 (KR) ..... 10-2003-0044842

(51) Int. Cl.
*G10L 21/00* (2006.01)

(52) U.S. Cl. ..... 704/503; 704/222; 704/500; 704/501; 704/504

(58) Field of Classification Search ..... None
See application file for complete search history.

(56) References Cited

U.S. PATENT DOCUMENTS 5,673,289 A * 9/1997 Kim et al. ..... 704/229
5,956,672 A * 9/1999 Serizawa ..... 704/219
6,301,558 B1 * 10/2001 Isozaki ..... 704/228
6,871,106 B1 * 3/2005 Ishikawa et al. ..... 700/94
2002/0052738 A1 * 5/2002 Paksoy et al. ..... 704/219

FOREIGN PATENT DOCUMENTS

DE 4253952.8 10/2004
JP 08-263096 A * 10/1996
JP 8263096 10/1996
JP 2002297192 A * 10/2002

OTHER PUBLICATIONS

Toshiyuki Nomura, et al., "A Bitrate And Bandwidth Scalable CELP Coder" May 12, 1998, pp. 341-344, Acoustics, Speech And Signal Processing, 1998, IEEE.

"General Aspects of Digital Transmission Systems, Terminal Equipments, 7kHz Audio-Coding Within 64 kBit/s, ITU-T Recommendation G.722", ITU Telecommunications Standardization Sector, Dec. 1993, pp. 1-73.

* cited by examiner

*Primary Examiner*—Richemond Dorvil
*Assistant Examiner*—Leonard Saint Cyr
(74) *Attorney, Agent, or Firm*—Staas & Halsey LLP

(57) ABSTRACT

A speech compression apparatus including: a first band-transform unit transforming a wideband speech signal to a narrowband low-band speech signal; a narrowband speech compressor compressing the narrowband low-band speech signal and outputting a result of the compressing as a low-band speech packet; a decompression unit decompressing the low-band speech packet and obtaining a decompressed wideband low-band speech signal; an error detection unit detecting an error signal that corresponds to a difference between the wideband speech signal and the decompressed wideband low-band speech signal; and a high-band speech compression unit compressing the error signal and a high-band speech signal of the wideband speech signal and outputting the result of the compressing as a high-band speech packet.

12 Claims, 11 Drawing Sheets

FIG. 6

| BAND | CENTER FREQUENCY | FIRST DFT COEFFICIENT INDEX | LAST DFT COEFFICIENT INDEX |
|---|---|---|---|
| 0 | 2,900 | 27 | 31 |
| 1 | 3,400 | 32 | 37 |
| 2 | 4,000 | 38 | 44 |
| 3 | 4,800 | 45 | 53 |
| 4 | 5,800 | 54 | 64 |
| 5 | 7,000 | 65 | 71 |

FIG. 7

| | | BAND 0 | BAND 1 | BAND 2 | BAND 3 | BAND 4 | BAND 5 | PREDICTOR SELECTION BIT | TOTAL |
|---|---|---|---|---|---|---|---|---|---|
| BAND PREDICTION ERROR QUANTIZATION | SUBFRAME 0 | 6 | 4 | 4 | 3 | 2 | 2 | 1 | 64 |
| | SUBFRAME 1 | 6 | 4 | 4 | 3 | 2 | 2 | | |
| | SUBFRAME 2 | 6 | 4 | 4 | 3 | 2 | 2 | | |
| TIME-BAND PREDICTION ERROR QUANTIZATION | SUBFRAME 0 | 6 | 4 | 4 | 3 | 3 | 3 | 1 | 64 |
| | SUBFRAME 1 | 5 | 4 | 4 | 3 | 2 | 2 | | |
| | SUBFRAME 2 | 5 | 4 | 4 | 3 | 2 | 2 | | |

| | BAND 0 | BAND 1 | BAND 2 | BAND 3 | BAND 4 | BAND 5 | TOTAL |
|---|---|---|---|---|---|---|---|
| DFT COEFFICIENT QUANTIZATION | 10 | 10 | 10 | 10 | 9 | 9 | 58 |

SPEECH COMPRESSION AND DECOMPRESSION APPARATUSES AND METHODS PROVIDING SCALABLE BANDWIDTH STRUCTURE

CROSS-REFERENCE TO RELATED APPLICATION

This application claims the priority of Korean Patent Application No. 2003-44842, filed on Jul. 3, 2003, in the Korean Intellectual Property Office, the disclosure of which is incorporated herein by reference.

BACKGROUND OF THE INVENTION

1. Field of the Invention

The present invention relates to speech signal encoding and decoding, and more particularly, to speech compression and decompression apparatuses and methods, by which a speech signal is compressed into a scalable bandwidth structure and the compressed speech signal is decompressed into the original speech signal.

2. Description of the Related Art

With the development of communication technology, speech quality has emerged as a significant competitive factor among communication companies.

Existing public switched telephone network (PSTN)-based communication samples a speech signal at 8 kHz and transmits a speech signal with a bandwidth of 4 kHz. Thus, the existing PSTN-based communication cannot transmit a speech signal that falls outside the 4 kHz bandwidth, resulting in degradation of speech quality.

To solve such a problem, a packet-based wideband speech encoder that samples an input speech signal at 16 kHz and provides a bandwidth of 8 kHz has been developed. When the bandwidth of a speech signal increases, speech quality is improved, but data transmitted over a communication channel increases. Thus, to use the wideband speech encoder efficiently, a wideband communication channel must be secured at all times.

However, the amount of data transmitted over a packet-based communication channel is not fixed, but varies due to a variety of factors. As a result, the wideband communication channel necessary for the wideband speech encoder may not be secured, resulting in degradation of the speech quality. This is because, if the required bandwidth is not provided at a specific moment, transmitted speech packets are lost and the speech quality is sharply degraded.

Hence, a technique of encoding a speech signal into a scalable bandwidth structure has been suggested. The International Telecommunication Union (hereinafter, referred to as "ITU") standard G.722 suggests such an encoding technique. The ITU G.722 standard has proposed dividing an input speech signal into two bands using low pass filtering and high pass filtering, and encoding each of the bands separately. In the ITU G.722 standard, each band of information is encoded using adaptive differential pulse code modulation (ADPCM). However, the encoding technique proposed in the ITU G.722 standard has the disadvantage that it is incompatible with existing standard narrowband compressors and has a high transmission rate.

Another approach to encoding the speech is to transform a wideband input signal into a frequency domain, divide the frequency domain into several sub-bands, and compress information of each of the sub-bands. The ITU G.722.1 standard suggests such an encoding technique. However, the ITU G.722.1 standard has the disadvantage that it does not encode a speech packet into the scalable bandwidth structure and is incompatible with the existing standard narrowband compressor.

The existing speech encoding techniques that have been developed in consideration of compatibility with the existing standard narrowband compressor obtain a narrowband signal by performing low pass filtering on a wideband input signal and encode the obtained narrowband signal using the existing standard narrowband compressor. A high-band signal is processed using another technique. Packets are transmitted separately for a high-band and a low-band.

An existing technique for processing the high-band signal includes a method of splitting the high-band signal into a plurality of subbands using a filter bank and compressing information regarding each subband. Another technique for processing the high-band signal includes transforming the high-band signal into the frequency domain by discrete cosine transform (DCT) or discrete Fourier transform (DFT) and quantizing each frequency coefficient.

However, since theses speech encoding techniques just divide an input signal into two bands and process each band separately, a high-band signal processing unit cannot additionally process distortion caused by the narrowband speech compressor.

Also, when the high-band signal is compressed, acoustic characteristics of a speech signal are not used efficiently, resulting in a decrease in quantization efficiency. When the plurality of subbands signal obtained by the filter bank is quantized, a correlation between bands is not utilized properly.

BRIEF SUMMARY

The present invention provides speech compression and decompression apparatuses, in speech signal encoder and decoder that provide a scalable bandwidth structure, and methods which are compatible with the existing standard narrowband compressor.

The present invention also provides speech compression and decompression apparatuses, in speech signal encoder and decoder having a scalable bandwidth structure, and methods in which a speech signal is compressed and decompressed by using acoustic characteristics of the speech signal.

The present invention also provides speech compression and decompression apparatuses and methods, in which distortion due to narrowband speech compression is compensated for by processing the distortion when a high-band speech signal is compressed.

The present invention also provides speech compression and decompression apparatuses and methods, in which a high-band speech signal is compressed and decompressed using a correlation between frequency bands and sub-frames.

The present invention also provides speech compression and decompression apparatuses and methods, in which quantization efficiency is improved by applying an acoustically meaningful weight function to quantization when a high-band speech signal is compressed.

The present invention also provides speech compression and decompression apparatuses and methods, in which signal distortion and the loss of information are minimized by calculating an error signal during compression of a speech signal, when an acoustic model is applied to signals for high and low bands.

According to an aspect of the present invention, there is provided a speech compression apparatus including: a first band-transform unit transforming a wideband speech signal to a narrowband low-band speech signal; a narrowband speech compressor compressing the narrowband low-band speech signal and outputting a result of the compressing as a low-band speech packet; a decompression unit decompressing the low-band speech packet and obtaining a decompressed wideband low-band speech signal; an error detection unit detecting an error signal that corresponds to a difference between the wideband speech signal and the decompressed wideband low-band speech signal; and a high-band speech compression unit compressing the error signal and a high-band speech signal of the wideband speech signal and outputting the result of the compressing as a high-band speech packet.

According to another aspect of the present invention, there is provided a speech decompression apparatus that decompresses a speech signal that is compressed into a scalable bandwidth structure, including: a narrowband speech decompressor receiving a low-band speech packet, decompressing the low-band speech packet, and outputting a decompressed narrow low-band speech signal; a high-band speech decompression unit receiving a high-band speech packet, decompressing the high-band speech packet, and outputting a decompressed high-band speech signal; and an adder adding the decompressed narrow low-band speech signal and the decompressed high-band speech signal and outputting a result of the adding as a decompressed wideband speech signal.

According to yet another aspect of the present invention, there is provided a speech compression method including: transforming a wideband speech signal into a narrowband low-band speech signal; compressing the narrowband low-band speech signal and transmitting the compressed narrowband low-band speech signal as a low-band speech packet; decompressing the low-band speech packet and obtaining a decompressed wideband low-band signal; detecting an error signal according to a difference between the decompressed wideband low-band signal and the wideband speech signal; and compressing the error signal and a high-band speech signal and transmitting the compressed error signal and high-band speech signal as a high-band speech packet.

According to yet another aspect of the present invention, there is provided a speech decompression method, by which a speech signal decompressed into a scalable bandwidth structure is decompressed, including: decompressing a low-band speech packet of the speech signal and obtaining a narrowband low-band speech signal and decompressing a high-band speech packet of the speech signal and obtaining a high-band speech signal; transforming the narrowband low-band speech signal into a decompressed wideband low-band speech signal; and adding the decompressed wideband low-band speech signal and the high-band speech signal and outputting a result of the adding as a decompressed wideband speech signal.

According to yet another aspect of the present invention, there is provided a method of compensating for distortion occurring in a narrowband speech compressor, including: detecting an error signal according to a difference between a decompressed wideband low-band signal and a wideband speech signal; and compressing the error signal and a high-band speech signal and transmitting the compressed error signal and high-band speech signal as a high-band speech packet.

According to yet another aspect of the present invention, there is provided a method of improving quantization efficiency during compression of a high-band speech signal, including: applying a weight function according to acoustic characteristics of a wideband speech signal; compressing high-band speech signal in accordance with correlations between bands and between a band and time; and compressing an error signal detected between a decompressed wideband low-band speech signal and a wideband speech signal.

Additional and/or other aspects and advantages of the present invention will be set forth in part in the description which follows and, in part, will be obvious from the description, or may be learned by practice of the invention.

BRIEF DESCRIPTION OF THE DRAWINGS

These and/or other aspects and advantages of the present invention will become apparent and more readily appreciated from the following detailed description, taken in conjunction with the accompanying drawings of which:

FIG. 6 illustrates the band range for DFT coefficient quantization in FIG. 4;

FIG. 7 illustrates the bits assigned to RMS quantization and DFT coefficient quantization according to an embodiment of the present invention;

DETAILED DESCRIPTION OF EMBODIMENTS

Figure 1:
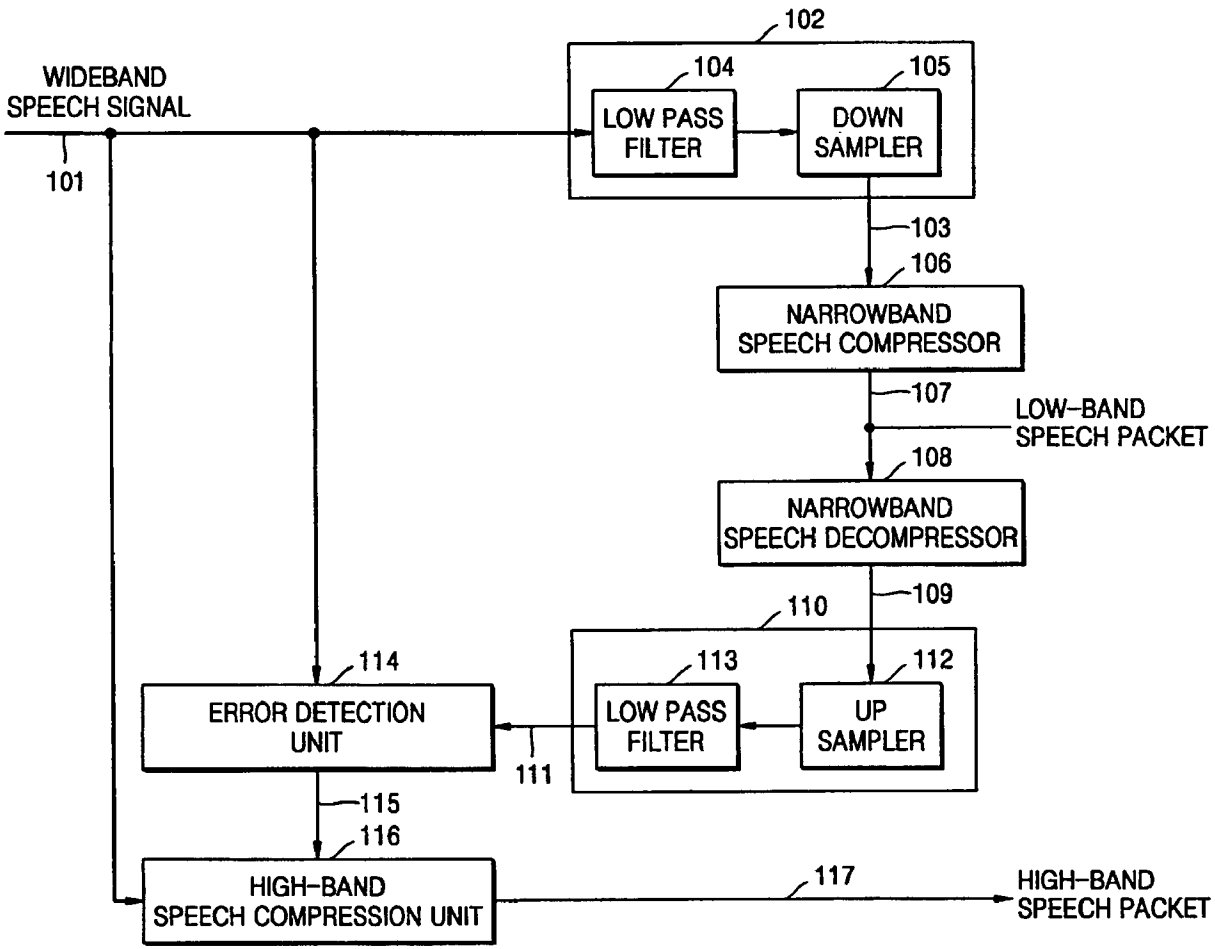
FIG. 1 is a block diagram of a speech compression apparatus according to an embodiment of the present invention.

Reference will now be made in detail to embodiments of the present invention, examples of which are illustrated in the accompanying drawings, wherein like reference numerals refer to the like elements throughout. The embodiments are described below in order to explain the present invention by referring to the figures.

FIG. 1 is a block diagram of a speech compression apparatus according to an embodiment of the present invention. Referring to FIG. 1, the speech compression apparatus includes a first band-transform unit 102, a narrowband speech compressor 106, a narrowband speech decompressor 108, a second band-transform unit 110, an error detection unit 114, and a high-band speech compression unit 116.

The first band-transform unit 102 transforms a wideband speech signal input via a line 101 into a narrowband speech signal. The wideband speech signal is obtained by sampling an analog signal at 16 kHz and quantizing each sample by 16-bit pulse code modulation (PCM).

The first band-transform unit 102 includes a low pass filter 104 and a down sampler 105. The low pass filter 104 filters the wideband speech signal input via the line 101 based on a cut-off frequency. The cut-off frequency is determined by the bandwidth of a narrowband defined according to a scalable bandwidth structure. The low pass filter 104 may be a fifth order Butterworth filter and the cut-off frequency may be 3700 Hz. The down sampler 105 removes every other signal output from the low pass filter 104 by ½ downsampling and outputs a narrowband low-band signal. The narrowband low-band signal is output to the narrowband speech compressor 106 via a line 103.

The narrowband speech compressor 106 compresses the narrowband low-band signal and outputs a low-band speech packet. The low-band speech packet is transmitted to a communication channel (not shown) and the narrowband speech decompressor 108, via a line 107.

The narrowband speech decompressor 108 obtains a decompressed low-band signal with respect to the low-band speech packet. The operation of the narrowband speech decompressor 108 depends on the operation of the narrowband speech compressor 106. If an existing code excited linear prediction (CELP)-based standard narrowband speech compressor is used (as the narrowband speech compressor 106), since a decompression function is included in the existing CELP-based standard narrowband speech compressor, the narrowband speech compressor 106 and the narrowband speech decompressor 108 are integrated into a single element. The decompressed low-band signal output from the narrowband speech decompressor 108 is transmitted to the second band-transform unit 110.

The second band-transform unit 110 transforms the decompressed narrowband low-band signal into a decompressed wideband low-band signal. This is because the input speech signal is a wideband signal.

The second band-transform unit 110 includes an up sampler 112 and a low pass filter 113. When the decompressed narrowband low-band signal is received via a line 109, the up sampler 112 inserts zero-valued sample between samples. The up-sampled signal is transmitted to the low pass filter 113, which operates in the same manner as the low pass filter 104. The low pass filter 113 outputs a decompressed wideband low-band signal to the error detection unit 114 via a line 111.

The narrowband speech decompressor 108 and the second band-transform unit 110 may be defined as a single decompressing unit that decompresses a compressed narrowband low-band signal into a decompressed wideband low-band signal.

Figure 2:
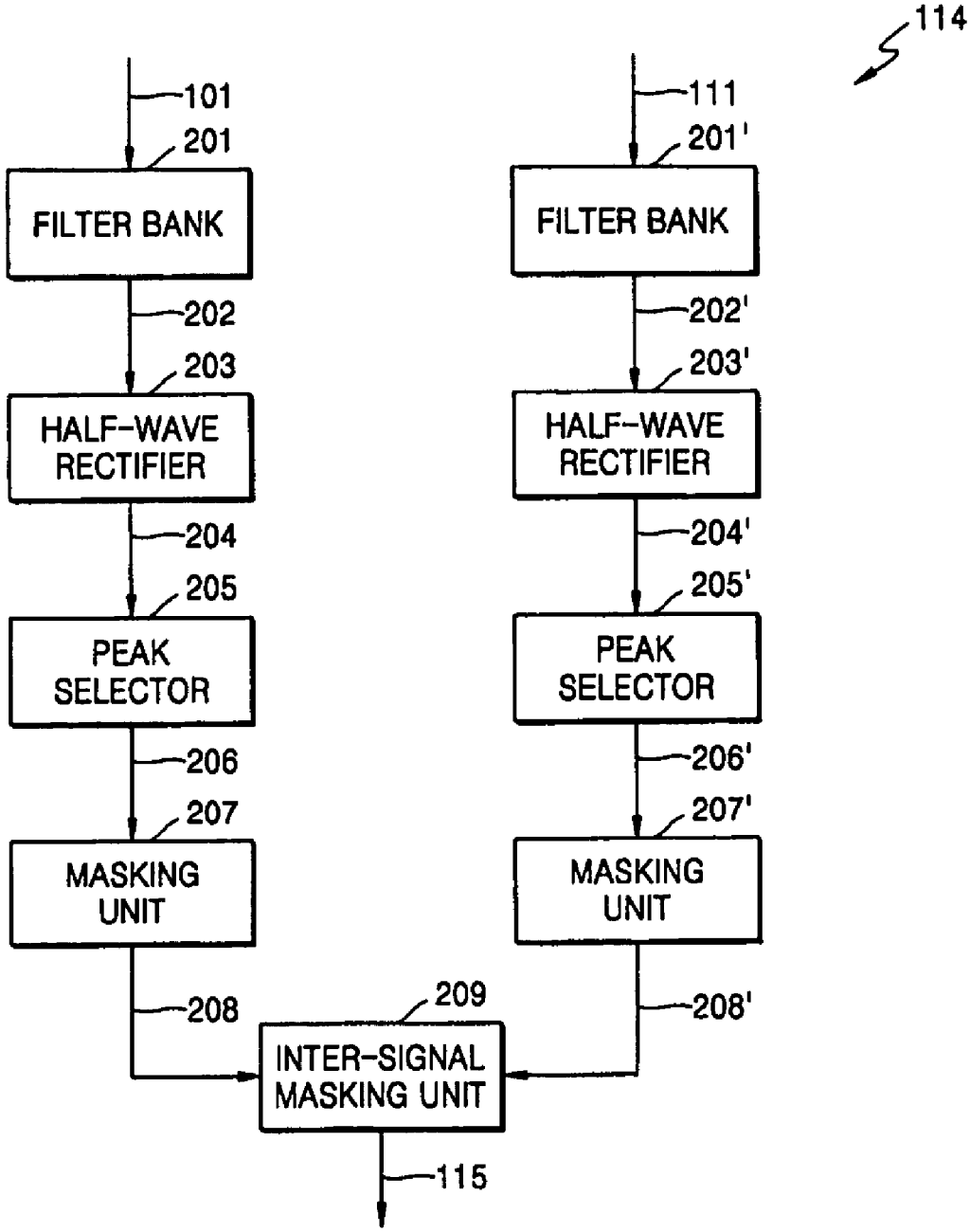
FIG. 2 is a block diagram of an error detection unit of the speech compression apparatus of FIG. 1.

The error detection unit 114 detects an error signal by a masking operation between the wideband speech signal input via the line 101 and the decompressed wideband low-band signal input via the line 111 and outputs the error signal. The error detection unit 114 may be configured as shown in FIG. 2. FIG. 2 is a block diagram of the error detection unit 114.

Referring to FIG. 2, the error detection unit 114 includes filter banks 201 and 201', half-wave rectifiers 203 and 203', peak selectors 205 and 205', masking units 207 and 207', and an inter-signal masking unit 209.

The filter bank 201, the half-wave rectifier 203, the peak selector 205, and the masking unit 207 obtain a masked signal for each band with respect to the wideband speech signal input via the line 101.

The filter bank 201 passes a plurality of specified frequency band speech signals from the wideband speech signal. The specified frequency band is determined by a center frequency. If the high-band speech signal is a signal with a frequency above 2600 Hz and the narrowband low-band signal processed by the narrowband speech compressor 106 is a signal with a frequency below 3700 Hz, the filter bank 201 may operate using two frequency bands whose center frequency is 2900 Hz and 3400 Hz, respectively. The filter bank 201 may be a Gammatone filter bank. A signal output from the filter bank 201 is transmitted to the half-wave rectifier 203 via a line 202.

The half-wave rectifier 203 outputs a zero for each of the samples that has a negative value for the signal input via the line 202. To compensate for energy reduction resulting from half-wave rectification, the half-wave rectifier 203 may be configured to obtain a half-wave rectified signal by multiplying samples having positive values by a specified gain. The specified gain may be set to 2.0.

The peak selector 205 selects samples corresponding to a peak of the half-wave rectified signal input via a line 204. In other words, the peak selector 205 selects the samples with values greater than adjacent samples as the samples corresponding to the peak, as follows:

$$y[n] = \begin{cases} x[n] & \text{if } x[n] > x[n-1] \text{ and } x[n] > x[n+1] \\ 0 & \text{otherwise} \end{cases}, \quad (1)$$

where x[n] represents an nth sample input to the peak selector 205, y[n] represents a sample output from the peak selector 205 corresponding to the nth input sample. And x[n−1] and x[n+1] represent the adjacent samples.

To compensate for energy reduction due to deleted samples which is not a peak by the peak selector 205, the peak selector 205 can detect the peak signal of the half-wave rectified signal by adding values of the deleted samples to the value of the selected sample as follows:

$$y[n] = \begin{cases} x[n] + (x[n-1] + x[n+1]) \times G & \text{if } x[n] > x[n-1] \text{ and } x[n] > x[n+1] \\ 0 & \text{otherwise} \end{cases}, \quad (2)$$

where G is a constant that determines the degree of compensation and may be set to 0.5.

The masking unit 207 obtains a post-masking curve q[n] and a pre-masking curve z[n] from a peak signal received from the peak selector 205 via a line 206 and outputs a signal that is obtained by substituting all the values below the two masking curves by 0 via a line 208. The signal output via the line 208 is a masked signal with respect to the wideband speech signal input via the line 101.

The post-masking curve q[n] is defined as:

$$q[n] = \begin{cases} x[n] & \text{if } x[n] > c_0 q[n-1] \\ c_0 q[n-1] & \text{otherwise} \end{cases}, \quad (3)$$

and the pre-masking curve z[n] is defined as:

$$z[n-1] = \begin{cases} x[n-1] & \text{if } x[n-1] > c_1 z[n] \\ c_1 z[n] & \text{otherwise} \end{cases}, \quad (4)$$

In Equation 3, x[n] represents an input signal of the masking unit 207 where c0 and c1 are constants that determine the intensity of masking, it is preferable that c0 is equal to e-0.5 and c1 is equal to e-1.5. In Equation 3, q[n−1] represents the previous post-making curve of q[n].

Also, to compensate for energy reduction due to masking in the masking unit 207, a sample value removed by masking can be multiplied by a specified gain and added to a previous or post sample value which is not removed by masking. This operation can be defined as:

for n=0, 1, . . .

$$\text{if } x[n]<q[n], \text{ then } x[\text{prev}]=x[\text{prev}]+x[n]*G,\ x[n]=0.0 \quad (5)$$

otherwise prev=n for $n=N-1, N-2, \ldots$ $$\text{if } x[n]<z[n], \text{ then } x[\text{post}]=x[\text{post}]+x[n]*G,\ x[n]=0.0 \quad (6)$$

otherwise post=n

The operation performed using Equation 5 compensates for energy reduction due to post-masking and the operation performed using Equation 6 compensates for energy reduction due to pre-masking. When N is a frame length and G is a constant that determines the degree of compensation, G may be set to 0.5.

The decompressed wideband low-band signal input via the line 111 is processed by the filter bank 201', the half-wave rectifier 203', the peak selector 205', and the masking unit 207' in the same manner as the wideband speech signal input via the line 101. Thus, a masked signal with respect to the decompressed wideband low-band signal is output from the masking unit 207'.

The inter-signal masking unit 209 receives a signal output from the masking unit 207' via a line 208' and obtains a post-masking curve and a pre-masking curve based on Equations 3 and 4. When the signal input via the line 208 has a value less than the post-masking and pre-masking curves, the inter-signal masking unit 209 substitutes in a value of 0, thus detects the error signal between the wideband speech signal and the decompressed wideband low-band signal.

The detected error signal is transmitted to the high-band speech compression unit 116 via a line. Since, in the inter-signal masking unit 209, the reduction in energy is normally proportional to the difference between the signals input via the lines 208 and 208', compensation for energy reduction due to masking, as defined in Equations 5 and 6, is not applied.

Error detection by the error detection unit 114 is advantageous over a conventional method of detecting an error signal by calculating a difference between two signals since it reduces distortion in speech compression. Such an advantage can be seen from FIGS. 3A and 3B.

Figure 3A:
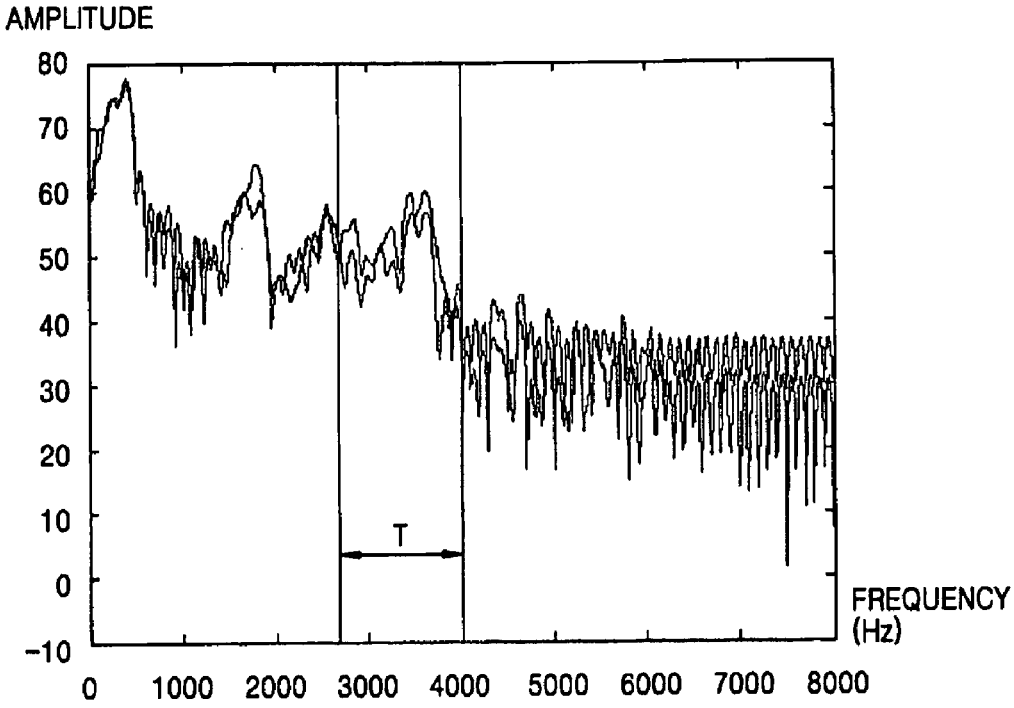
FIG. 3A illustrates the relationship between spectrums of an input signal and an output signal when an error signal is detected according to a conventional method.
Figure 3B:
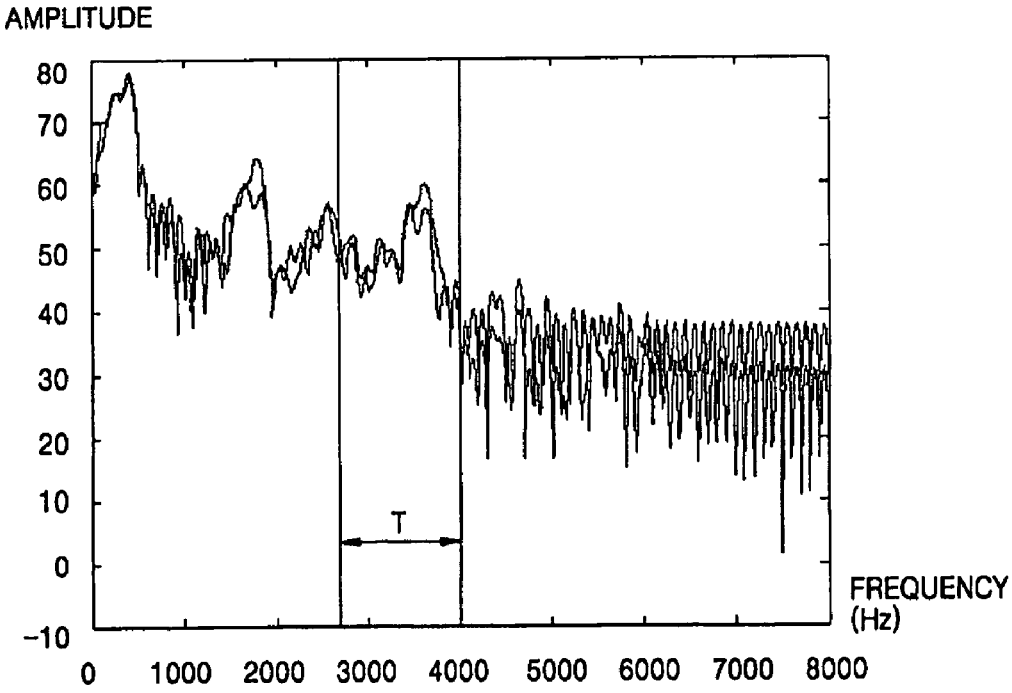
FIG. 3B illustrates the relationship between spectrums of an input signal and an output signal when an error signal is detected by the error detection unit shown in FIG. 2.

FIG. 3A illustrates the relationship between spectrums for an input signal and a final decompressed signal when an error signal is detected using the conventional method, and FIG. 3B illustrates the relationship between the spectrums for the input signal and the final decompressed signal when the error signal is detected by the error detection unit 114. Considering frequency bands T in FIGS. 3A and 3B, the final decompressed signal is not sufficiently compensated for when the error signal is detected using the conventional method. However, when the error signal is detected according to the present invention, the level of the final decompressed signal is closer to the input signal.

The high-band speech compression unit 116 (shown in FIG. 1) encodes the error signal (hereinafter, referred to as the error signal 115) input via a line and the wideband speech signal input via the line 101, thus obtaining a high-band speech packet. To this end, the high-band speech compression unit 116 may be configured as shown in FIG. 4.

Figure 4:
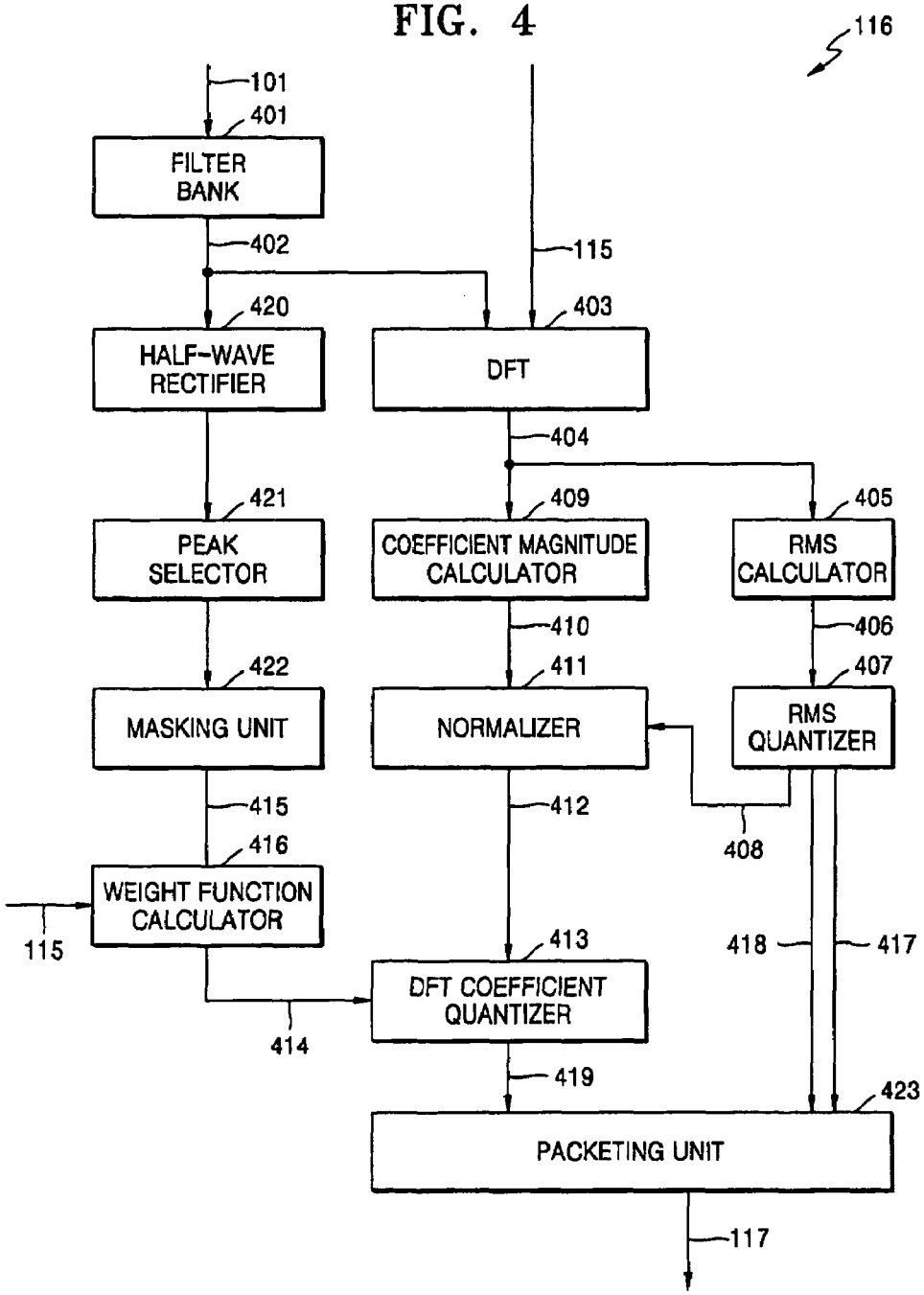
FIG. 4 is a block diagram of a high-band compression unit of the speech compression apparatus of FIG. 1.

Referring to FIG. 4, the high-band speech compression unit 116 includes a filter bank 401, a discrete Fourier transform (DFT) 403, a root-mean-square (RMS) calculator 405, an RMS quantizer 407, a coefficient magnitude calculator 409, a normalizer 411, a DFT coefficient quantizer 413, a weight function calculator 416, a half-wave rectifier 420, a peak selector 421, a masking unit 422, and a packeting unit 423.

The filter bank 401 divides the wideband speech signal input via the line 101 into a plurality of specified frequency bands. For example, the wideband speech signal can be split into four frequency bands centered at 4000 Hz, 4800 Hz, 5800 Hz, and 7000 Hz. Since the error signal 115 has already been divided into two bands, the operation of the filter bank 401 is not applied to the error signal 115. The two bands of the error signal have center frequencies of 2900 Hz and 3400 Hz, respectively.

Thus, a high-band signal processed by the high-band speech compression unit 116 has a total of six frequency bands including the two frequency bands transmitted via a line and the four frequency bands obtained by the filter bank 401. The six frequency bands are indicated by band 0 through band 5. In other words, the error signal 115 is indicated by band 0 and band 1, and the four frequency bands output from the filter bank 401 are indicated by band 2 through band 5.

The error signal 115 corresponding to band 0 and band 1 and a signal (hereinafter, referred to as the filtered signal 402) output from the filter bank 401 via a line, which corresponds to band 0 through band 5, are input to the DFT 403.

The DFT 403 operates separately for the filtered signal 402 and the error signal 115. Since the filtered signal 402 and the error signal 115 are defined in their corresponding frequency bands, the DFT 403 calculates a DFT coefficient of a frequency domain corresponding to each frequency band. In other words, the DFT 403 transforms an input signal into the corresponding frequency bands and then calculates the DFT coefficient for each frequency band. The calculated DFT coefficient is provided to the RMS calculator 405 and the coefficient magnitude calculator 409, via a line 404.

The RMS calculator 405 calculates an RMS value of a DFT coefficient for each band. For example, DFTs are performed on 10 msec subframes of the filtered signal 402 and the error signal 115, an RMS value of each of the calculated DFT coefficients is obtained, and the obtained RMS values are output to the RMS quantizer 407 by 30 msec frames. In other words, a value input to the RMS quantizer 407 via a line consists of 18 RMS values (hereinafter, referred to as RMS values 406 ) with respect to 6 bands×3 subframes.

The RMS quantizer 407 quantizes the 18 RMS values 406. According to conventional techniques, RMS values for each band are separately scalar quantized. However, there exits high correlation among the 18 RMS values 406 with respect to the 6 bands and 3 subframes. Thus, in order to take advantage of such correlation, the RMS quantizer 407 performs predictive quantization on the 18 RMS values 406. In other words, predictive quantization is performed in such a way that a predictor is selected based on characteristics of the 18 RMS values 406.

Figure 5:
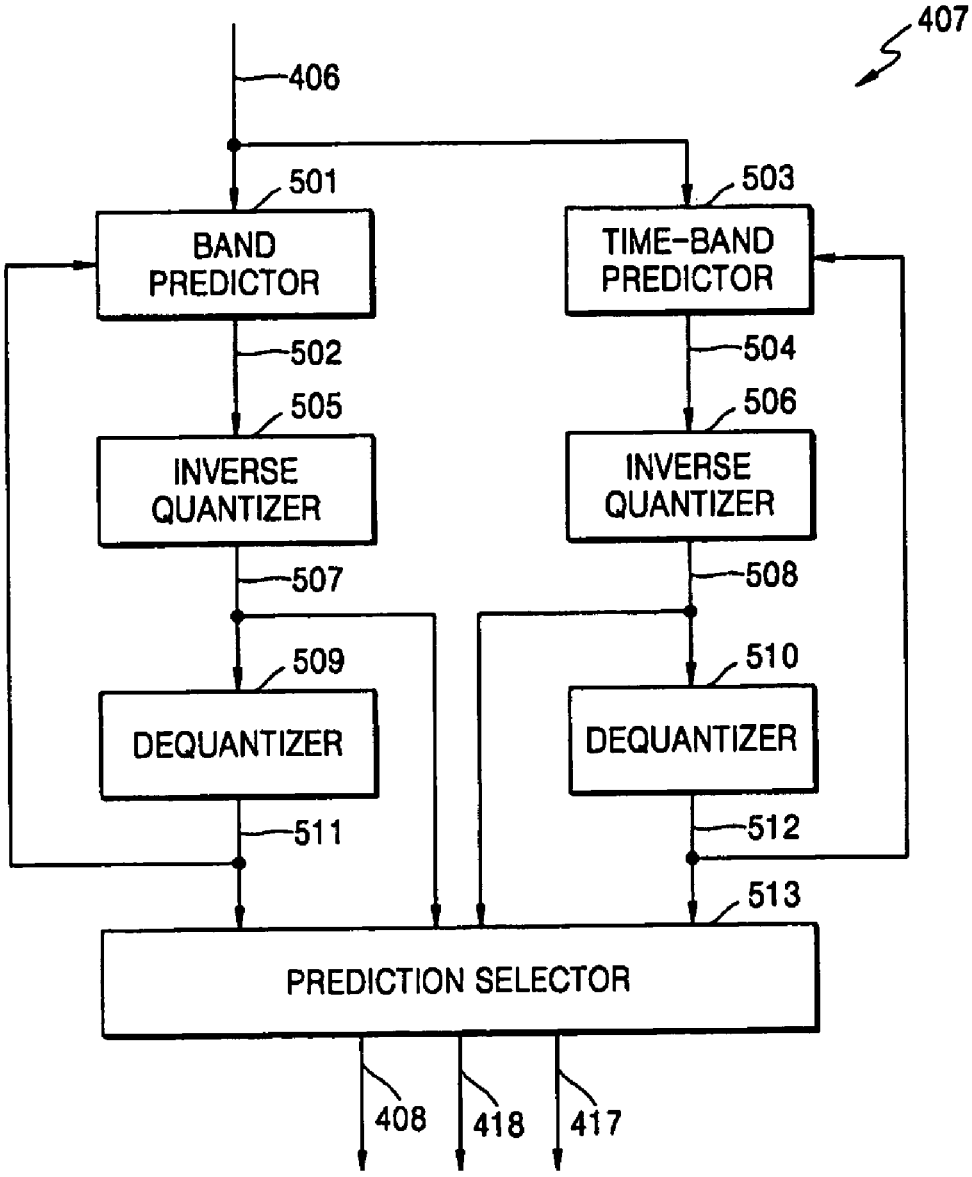
FIG. 5 is a detailed block diagram of an RMS quantizer of the high-band compression unit of FIG. 4.

To this end, the RMS quantizer 407 may be configured as shown in FIG. 5. Referring to FIG. 5, the RMS quantizer 407 includes a band predictor 501, a time-band predictor 503, quantizers 505 and 506, inverse quantizers 509 and 510, and a prediction selector 513.

The 18 RMS values 406 are expressed in a 3×6 matrix, i.e., rms[t][b] when t is a subframe index that has values of 0, 1, and 2 and b is a band index that has values of 0, 1, 2, 3, 4, and 5. The band predictor 501 produces a band prediction error value 502 using correlation among the 18 RMS values 406. The band prediction error values 502 are defined as:

$$\Delta_1[t][b]=\mathrm{rms}[t][b]-a\mathrm{rms}_q[t][b-1] \quad (7),$$

where $\mathrm{rms}_q[t][b-1]$ represents quantized RMS values 511 that undergo quantization and inverse quantization by the quantizer 505 and the inverse quantizer 509, and a is a predictor coefficient that is set to 1.0 in the embodiment of the present invention. Initial values of $\mathrm{rms}_q[t][b-1]$ are set to 0. The band prediction error values 502 are scalar quantized separately in the quantizer 505, thus the 18 RMS values 406 can be predicted based on a result of quantization of the band prediction error values 502, using Equation 7.

The time-band predictor 503 simultaneously performs time and band prediction using the correlation among the 18 RMS values 406. Time-band prediction error values 504 for the 18 RMS values 406 can be defined as follows.

$$\Delta_2[t][b]=\mathrm{rms}[t][b]-g(\mathrm{rms}_q[t][b-1]+\mathrm{rms}_q[t-1][b]) \quad (8),$$

where g is a prediction coefficient of the time-band predictor 503 that is set to 0.5 in the embodiment of the present invention and initial values of $\mathrm{rms}_q[t][b-1]$ and $\mathrm{rms}_q[t-1][b]$ are set to 0.

The quantizer 505 performs scalar quantization for the band prediction error values 502, thus obtains an RMS quantization index. The quantizer 506 performs scalar quantization for the time-band prediction error values 504, thus obtaining an RMS quantization index. The inverse quantizer 509 obtains the quantized RMS values 511 using Equation 7, as shown in Equation 9. The inverse quantizer 510 obtains quantized RMS values 512 using Equation 8, as shown in Equation 10.

$$\mathrm{rms}_q[t][b]=\Delta_{1q}[t][b]+a\mathrm{rms}_q[t][b-1] \quad (9)$$

$$\mathrm{rms}_q[t][b]=\Delta_{2q}[t][b]+g(\mathrm{rms}_q[t][b-1]+\mathrm{rms}_q[t-1][b]) \quad (10)$$

Signals output from the inverse quantizers 509 and 510 are input to the band predictor 501 and the time-band predictor 503, respectively, and used for prediction defined in Equations 7 and 8.

Step sizes of the quantizers 505 and 506 and inverse quantizers 509 and 510 are determined according to the number of bits allocated for each of the band prediction error value 502 and time-band prediction error value 504. According to the embodiment of the present invention, assignment of bits is as shown in FIG. 7. The quantizers 505 and 506 can quantize the band prediction error values 502 and the time-band prediction error values 504 in accordance with mu-law. However, since bands or times in which the effects of prediction are not obtained, i.e., $\Delta_1[t][0]$ of the band predictor 501 and $\Delta_2[0][0]$ of the time-band predictor 503, correspond to the original RMS value and do not have characteristics of errors, they are processed by general linear quantization based on the distribution of the original RMS value.

The prediction selector 513 calculates quantization error energies using outputs of the quantizers 505 and 506 and inverse quantizers 509 and 510. The prediction selector 513 selects a predictor that has the least quantization error energy.

If the quantization error energy of the band predictor 501 is less than the quantization error energy of the time-band predictor 503, the prediction selector 513 outputs the quantized RMS values 511 from the inverse quantizer 509 via a line 408, the RMS quantization index of the selected band predictor 501 via a line 418, and a selected predictor type index, which indicates that the band predictor 501 is selected, via a line 417.

On the other hand, if the quantization error energy of the time-band predictor 503 is less than the quantization error energy of the band predictor 501, the prediction selector 513 outputs the quantized RMS values 512 from the inverse quantizer 510 via the line 408, the RMS quantization index of the selected time-band predictor 503 via the line 418, and a selected predictor type index, which indicates that the time-band predictor 503 is selected, via the line 417.

The coefficient magnitude calculator 409 calculates a DFT coefficient magnitude for each frequency band and outputs it via a line 410. The coefficient magnitude calculator 409 obtains an absolute value of a DFT coefficient, which is a complex number.

Returning to FIG. 4, the normalizer 411 normalizes the DFT coefficient magnitude using the quantized RMS values 408 for each frequency band. The normalizer 411 divides the DFT coefficient magnitude transmitted via the line 410 by the quantized RMS values 408 for each frequency band, thus obtaining the normalized DFT coefficient magnitude. The normalized DFT coefficient magnitude for each frequency band is transmitted to the DFT coefficient quantizer 413.

The DFT coefficient quantizer 413 quantizes a DFT coefficient for each frequency band using a weight function 414 output from the weight function calculator 416 and outputs a DFT coefficient index via a line 419. In other words, the DFT coefficient quantizer 413 performs vector quantization for the normalized DFT coefficient magnitude for each frequency band. In the embodiment of the present invention, the center frequency used in each filter bank is 2900 Hz, 3400 Hz, 4000 Hz, 4800 Hz, 5800 Hz, and 7000 Hz and DFT is performed on each subframe of 10 msec. Thus, the DFT coefficient magnitude is equal to 160 and the DFT coefficient index for each frequency band is set as shown in FIG. 6.

The weight function calculator 416 obtains the weight function using a masked signal 415 of band 2 through band 5 and the error signal 115. In other words, the weight function calculator 416 defines the weight function based on acoustic information, transforms the weight function into a frequency domain, and outputs the transformed weight function 414 to the DFT coefficient quantizer 413 for DFT coefficient quantization.

When an acoustically meaningful signal is present in both the filtered signal 402 and the error signal 115, the acoustically meaningful signal is also included in both the masked signal 415 and the error signal 115. If the shapes of the masked signal 415 and error signal 115 are maintained after quantization, distortion may be regarded as not occurring acoustically.

At this time, the location of each pulse of the masked signal 415 and error signal 115 is important. Particularly, the location of a large pulse is more important. Thus, in a quantized time domain signal for each frequency band (that is, a result of inverse DFT on a quantized DFT coefficient), the significance of each sample is determined by the location and size of each pulse of the masked signal 415 and error signal 115. A weighted mean square error in the time domain is defined as:

$$WMSE=\sum_{n=0}^{N-1}(x[n]-x_q[n])^2 w[n], \quad (11)$$

where w[n] is a weight function in a time domain and x[n] is the filtered signal 402 output from the filter bank 401 or the error signal 115 and $x_q[n]$ represents a signal obtained by transforming the quantized DFT coefficient into the time domain. Since only the DFT coefficient magnitude is quantized in the DFT coefficient quantizer 413, the weight function calculator 416 performs inverse DFT for the masked signal 415 using the original phase of the filtered signal 402. w[n] is defined as:

$$w[n] = \begin{cases} \dfrac{y[n]}{\max y[n]} & \text{if } \max y[n] \neq 0 \\ 1.0 & \text{otherwise} \end{cases}, \tag{12}$$

where y[n] represents the masked signal 415 or the error signal 115, for each frequency band.

The weight function 414 in the frequency domain can be represented in matrix form as:

$$W_f = D^T W D \tag{13},$$

where D is a matrix corresponding to inverse DFT and W is a matrix defined as W=diag[w[0], w[1], . . . , w[N−1]].

Thus, the weight function calculator 416 calculates w[n] using Equation 12 and the masked signal 415 for each frequency band and the error signal 115, and obtains the weight function 414 for each frequency band in matrix form by substituting the calculated w[n] into Equation 13. The weight function 414 for each frequency band is input to the DFT coefficient quantizer 413. The weighted mean square error value for each frequency band is $$WMSE = E^T W_f E \tag{14}$$

By obtaining a code vector i that minimizes the result of Equation 14 with respect to each frequency band, quantization can be performed in such a way that acoustic distortion is minimized. Here, E in each frequency band is an error vector with respect to the code vector i. In the embodiment of the present invention, the number of bits allocated for each frequency band is shown in FIG. 7.

The packeting unit 423 packets the RMS quantization index 418, the selected predictor type index 417, and a DFT coefficient quantization index 419 for each frequency band, thus generating a high pass band speech packet. The generated high pass band speech packet is transmitted to a communication channel (not shown) via a line 117.

The four-frequency band signals output from the filter bank 401 are processed by the half-wave rectifier 420, the peak selector 421, and the masking unit 422 as described with reference to FIG. 2, and a masked signal for each frequency band is obtained.

Figure 8:
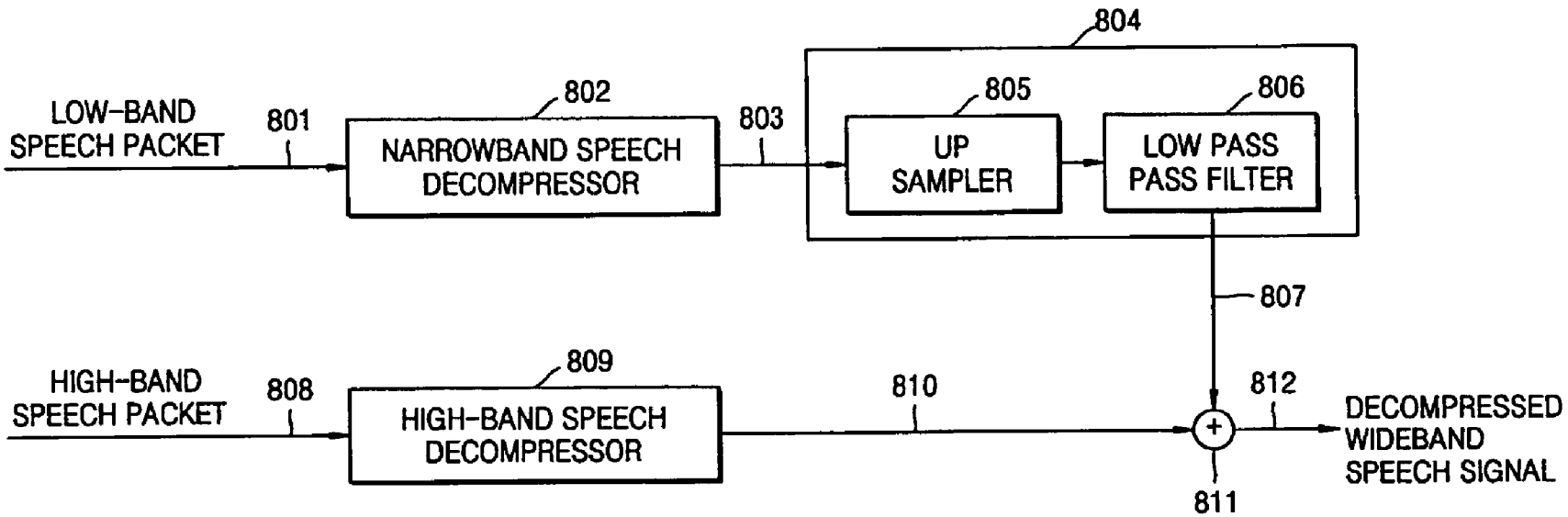
FIG. 8 is a block diagram of a speech decompression apparatus according to a second embodiment of the present invention.

FIG. 8 is a block diagram of a speech decompression apparatus according to a second embodiment of the present invention. Referring to FIG. 8, the speech decompression apparatus includes a narrowband speech decompressor 802, a third band-transform unit 804, a high-band decompression unit 809, and an adder 811.

The narrowband speech decompressor 802 is configured in the same fashion as the narrowband speech decompressor 108 of FIG. 1. Thus, when a low-band speech packet is input via a line 801, the narrowband speech decompressor 802 outputs a decompressed narrowband low-band speech signal 803.

The third band-transform unit 804 converts the decompressed narrowband low-band speech signal 803 to a decompressed wideband low-band speech signal 807. The third band-transform unit 804 comprises an up sampler 805 and a low pass filter 806 and operates in the same way as the second band-transform unit 110 of FIG. 1.

Once a high-band speech packet is input via a line 808, the high-band speech decompression unit 809 obtains a decompressed high-band speech signal. The high-band speech decompression unit 809 may be defined by the high-band speech compression unit 116 of FIG. 1.

Figure 9:
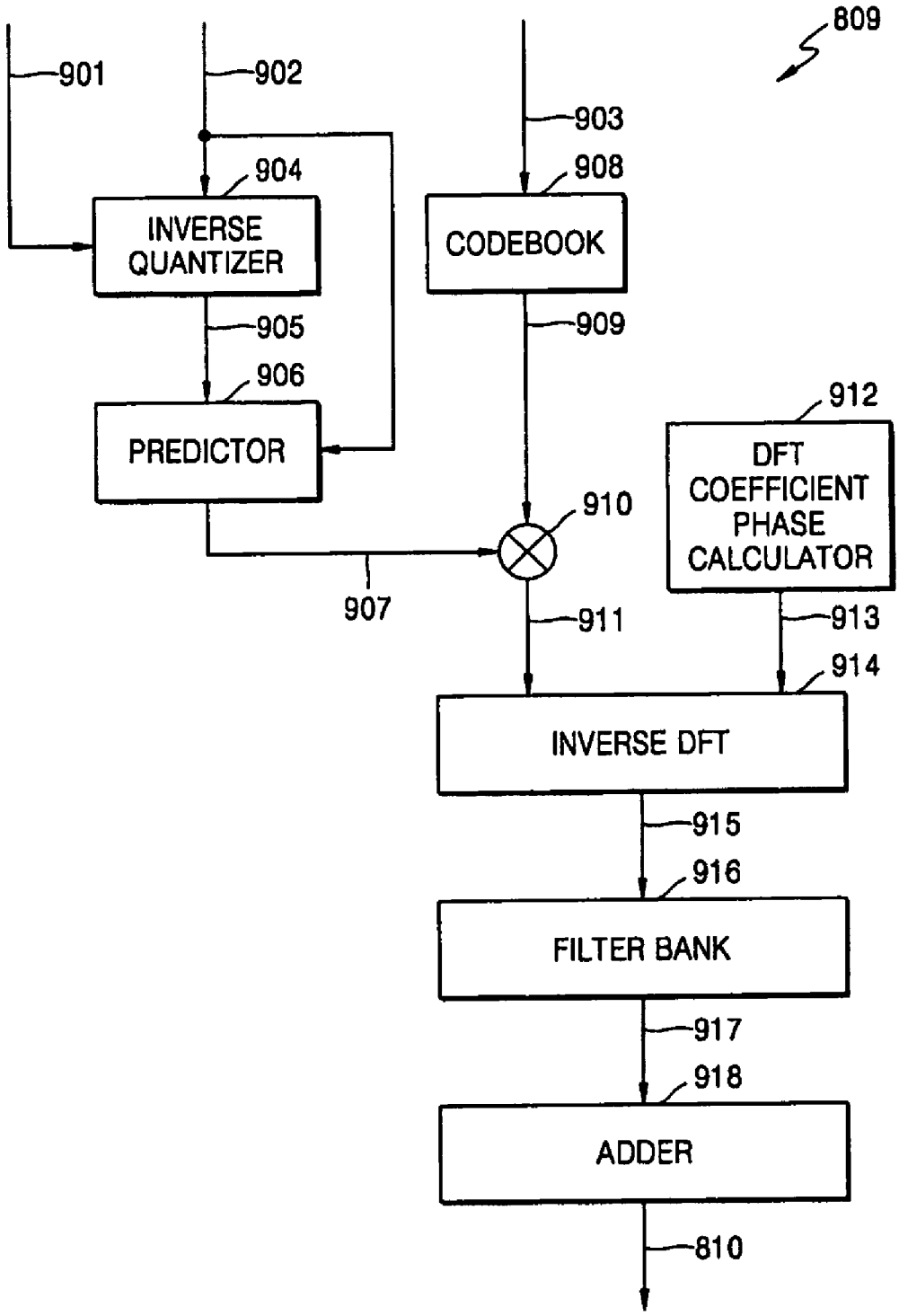
FIG. 9 is a detailed block diagram of a high-band speech decompression unit of FIG. 8.

Thus, the high-band speech decompression unit 809 corresponding to the high-band speech compression unit 116 can be configured as shown in FIG. 9. Referring to FIG. 9, the high-band decompression unit 809 includes an inverse quantizer 904, a predictor 906, a codebook 908, a multiplier 910, a DFT coefficient phase calculator 912, an inverse DFT unit 914, a filter bank 916, and an adder 918.

The inverse quantizer 904 includes inverse quantizers (not shown), which correspond to the band predictor 501 and the time-band predictor 503 shown in FIG. 5. Thus, the inverse quantizer 904 selects an inverse quantizer from the inverse quantizers using the selected predictor type index input via a line 902 and calculates an inverse-quantized prediction error value $\Delta_{1q}[t][b]$ or $\Delta_{2q}[t][b]$ using an RMS quantization index input via a line 901. The RMS quantization index and the selected predictor type index are included in the input high-band speech packet 808.

The inverse-quantized prediction error value output from the inverse quantizer 904 is transmitted to the predictor 906 via a line 905. The predictor 906 includes the band predictor 501 and the time-band predictor 503 of the RMS quantizer 407 and selects the predictor that corresponds to the selected predictor type index input via the line 902. Once a predictor is selected, the predictor 906 substitutes the quantized prediction error value input via the line 905 into Equations 9 and 10 and obtains quantized RMS values. The quantized RMS values are output via a line 907.

Once the DFT coefficient index is input via a line 903, the codebook 908 outputs the normalized DFT coefficient magnitude that corresponds to the input DFT coefficient index. The DFT coefficient index is included in the input high-band speech packet 808. The normalized DFT coefficient magnitude is transmitted to the multiplier 910 via a line 909.

The multiplier 910 multiples the quantized RMS values input via the line 907 by the normalized DFT coefficient magnitude input via the line 909, thus obtaining a quantized DFT coefficient magnitude. The quantized DFT coefficient magnitude is output via a line 911.

The DFT coefficient phase calculator 912 cyclically self-calculates a DFT coefficient phase $\theta_i[m]$, which is output via a line 913.

$$\nu_i^{(0)}[m] = \nu_i^{(-1)}[m] + w_c N$$

$$\theta_i[m] = \nu_i^{(0)}[m] + \Psi[m] \tag{15},$$

where m is the DFT coefficient index, i is the band index, and $\nu_1^{(0)}[m]$ and $\nu_i^{(-1)}[m]$ correspond to a current subframe and a previous subframe, and the initial value of the DFT coefficient phase is 0. $w_c$ is a center frequency of each frequency band and expressed in radians, N is the number of DFT coefficients, ψ[m] is a random value uniformly distributed in (−π, π).

The inverse DFT unit 914 generates a time domain signal for each frequency band using the DFT coefficient magnitude input via the line 911 and the DFT coefficient phase $\theta_i[m]$ input via the line 913. The time domain signal for each frequency band is output via a line 915.

The filter bank 916 is defined by the filter banks 201 and 201' of the error detection unit 114 for band 0 and band 1, and is defined by the filter bank 401 of the high-band speech compression unit 116 in band 2 through band 5. Thus, in the filter bank 916, each frequency band is defined by the center frequency that is defined in the filter banks 201 and 201' or the filter bank 401. The filter bank 916 obtains a final speech signal for each frequency band using the time domain signal for each frequency band. The final speech signal for each frequency band and the error signal (115) are transmitted to the adder 918 via a line 917.

The adder 918 adds the speech signals for the frequency bands input via the line 917 and obtains a decompressed high-band speech signal. The decompressed high-band speech signal is output via a line 810.

The adder 811 adds the decompressed high-band speech signal input via the line 810 and the decompressed wideband low-band speech signal input via a line 807 and outputs a decompressed wideband speech signal via a line 812.

Figure 10:
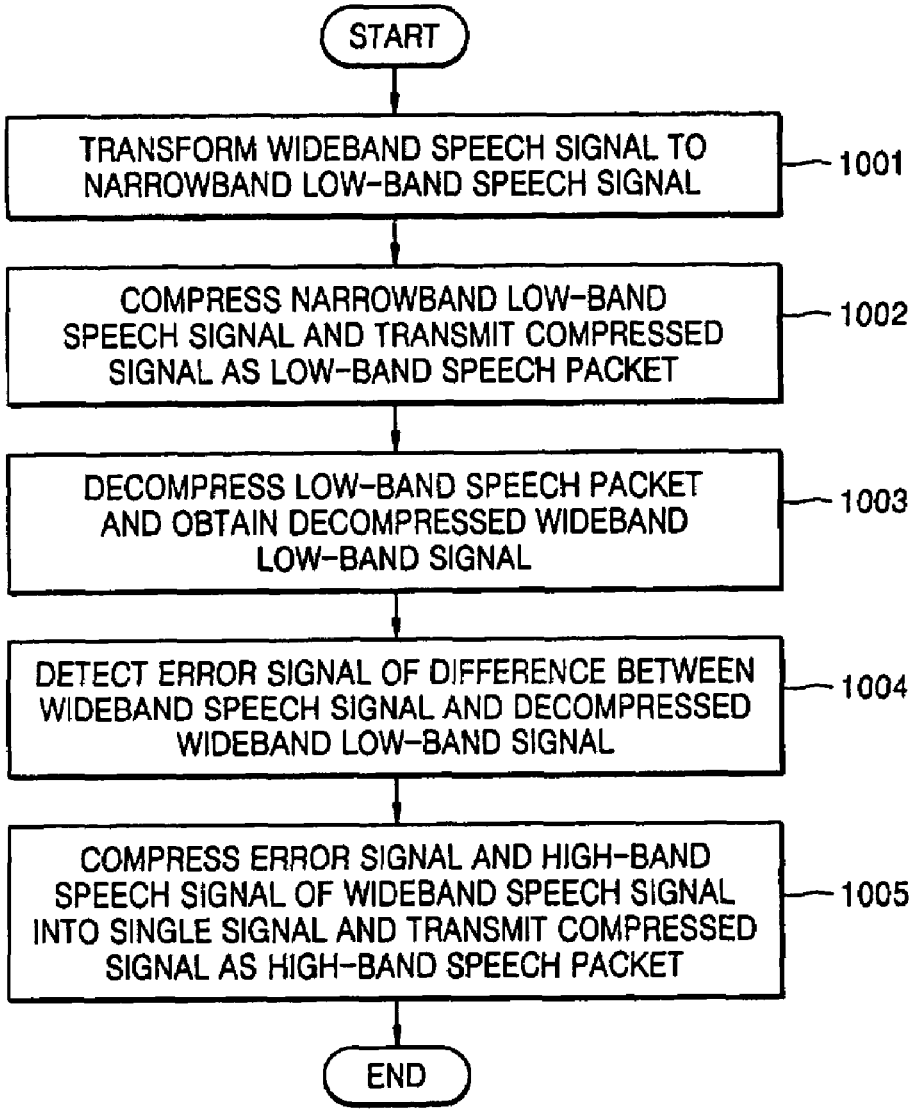
FIG. 10 is a flowchart illustrating a speech compression method according to a third embodiment of the present invention.

FIG. 10 is a flowchart illustrating a speech compression method according to an embodiment of the present invention.

When a wideband speech signal is input, the wideband speech signal is transformed to a narrowband low-band speech signal in operation 1001. Transform is performed as described with reference to the first band-transform unit 102 of FIG. 1.

In operation 1002, the narrowband low-band speech signal is compressed using a conventional standard narrowband compression method and the compressed signal is output to a communication channel. The compressed signal is a low-band speech packet that corresponds to the wideband speech signal.

In operation 1003, the low-band speech packet is decompressed and the decompressed low-band speech signal is transformed into a wideband decompressed low-band speech signal. Decompression is performed as described with reference to the narrowband speech decompressor 108 and the second band-transform unit 110 of FIG. 1.

In operation 1004, an error signal corresponding to a difference between the wideband speech signal and the decompressed wideband low-band speech signal is detected. Detection of the error signal is performed as described with reference to FIG. 2.

In operation 1005, the error signal and a high-band speech signal are compressed into a single signal, and the compressed signal is transmitted to the communication channel (not shown). The compressed signal is a high-band speech packet that corresponds to the wideband speech signal. Compression of the error signal and high-band speech signal is performed as described with reference to FIGS. 4 and 5.

Figure 11:
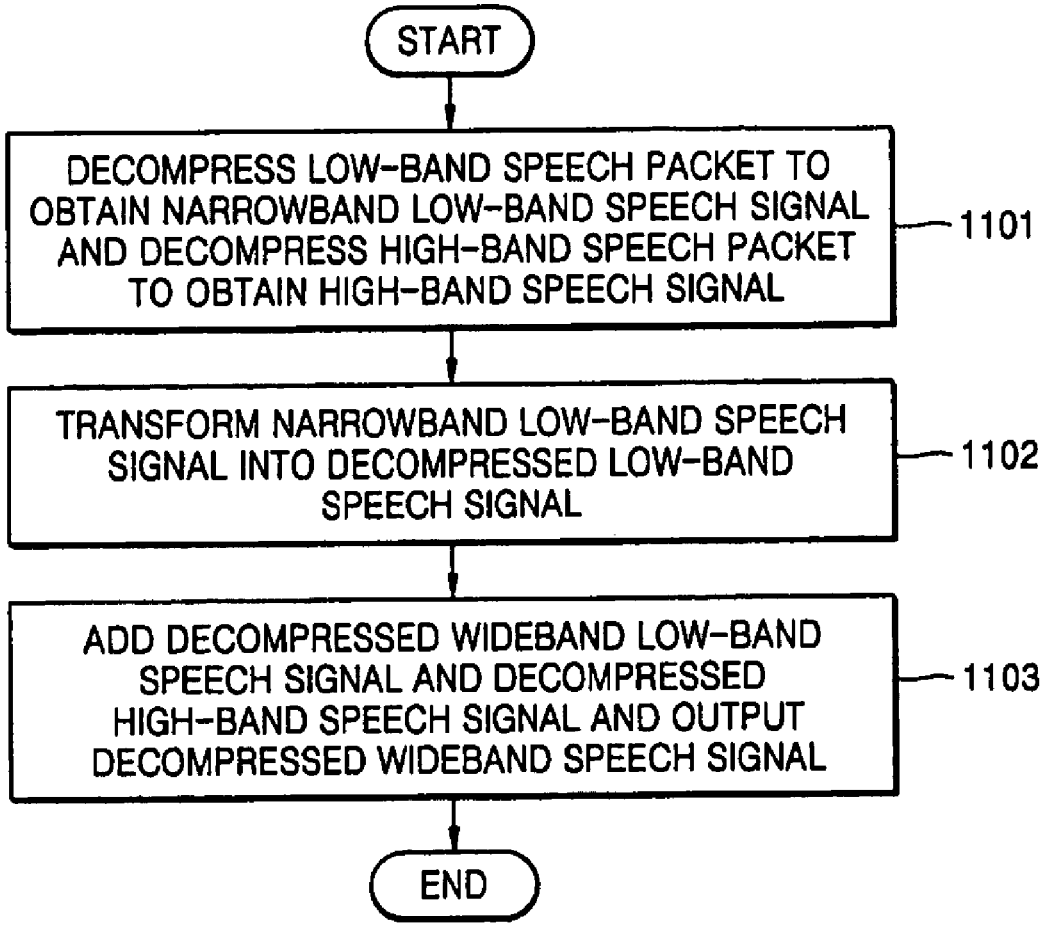
FIG. 11 is a flowchart illustrating a speech decompression method according to an embodiment of the present invention.

FIG. 11 is a flowchart illustrating a speech decompression method according to an embodiment of the present invention.

When a low-band speech packet and a high-band speech packet are received through the communication channel (not shown), the low-band packet is decompressed and a narrowband low-band signal is obtained in operation 1101. Decompression of the low-band packet is performed as described with reference to the narrowband speech decompressor 802 of FIG. 8. The high-band speech packet is also decompressed and a high-band speech signal is obtained. Decompression of the high-band speech packet is performed as described with reference to FIGS. 8 and 9.

In operation 1102, the narrowband low-pass signal is transformed into a decompressed wideband low-band speech signal. Transformation of the decompressed wideband low-band speech signal is performed as described with reference to the third band-transform unit 804 of FIG. 8.

In operation 1103, the decompressed wideband low-band speech signal and the decompressed high-band speech signal are added and the result of addition is output as a decompressed wideband speech signal that corresponds to the low-band speech packet and the high-band speech packet.

According to embodiments of the present invention, a speech signal encoder and decoder having a scalable bandwidth structure includes a speech compression and decompression apparatus that is compatible with a conventional standard narrowband compressor or performs a method corresponding to the speech compression and decompression apparatus.

Also, by additionally compressing distortion caused by the narrowband speech compressor when a high-band speech signal is compressed, it is possible to compensate for distortion occurring in the narrowband speech compressor.

Furthermore, during compression of the high-band speech signal, quantization efficiency can be improved by applying a weight function that considers acoustic characteristics of a speech signal. Correlations between bands and between band and time are considered when the high-band speech signal is compressed and decompressed. At the same time, an error signal between a decompressed wideband low-band speech signal and a wideband speech signal is detected and the detected error signal is used, thereby minimizing loss of information due to compression and decompression.

Although a few embodiments of the present invention have been shown and described, the present invention is not limited to the described embodiments. Instead, it would be appreciated by those skilled in the art that changes may be made in these embodiments without departing from the principles and spirit of the invention, the scope of which is defined by the claims and their equivalents.

What is claimed is:

1. A speech compression apparatus comprising:

a first band-transform unit transforming a wideband speech signal to a narrowband low-band speech signal;

a narrowband speech compressor compressing the narrowband low-band speech signal and outputting a result of the compressing as a low-band speech packet;

a decompression unit decompressing the low-band speech packet and obtaining a decompressed wideband low-band speech signal;

an error detection unit detecting an error signal that corresponds to a difference between the wideband speech signal and the decompressed wideband low-band speech signal; and a high-band speech compression unit compressing the error signal and a high-band speech signal of the wideband speech signal and outputting the result of the compressing as a high-band speech packet, wherein the error detection unit comprises:

a first filter bank filtering the wideband speech signal in a first specified frequency band and outputting a first filtered signal;

a first half-wave rectifier performing half-wave rectification for the first filtered signal and outputting a first half-wave rectified signal;

a first peak detector detecting a first peak signal from the first half-wave rectified signal;

a first masking unit generating a first masked signal for the wideband speech signal from the first peak signal;

a second filter bank filtering the decompressed wideband low-band speech signal in a second specified frequency band and outputting a second filtered signal;

a second half-wave rectifier performing half-wave rectification for the second filtered signal and outputting a second half-wave rectified signal;

a second peak detector detecting a second peak signal from the second half-wave rectified signal;

a second masking unit generating a second masked signal for the decompressed wideband low-band speech signal from the second peak signal; and an inter-signal masking unit performing inter-signal masking on the first and second masked signals.

2. The speech compression apparatus of claim 1, wherein the inter-signal masking unit obtains a masking curve using the second masked signal and removes samples below the masking curve among samples included in the first masked signal.

3. The speech compression apparatus of claim 1, wherein the first half-wave rectifier and the second half-wave rectifier multiply samples of the input signals that have positive value by a specified gain to compensate for energy reduction of the signals input to the first half-wave rectifier and second half-wave rectifier due to the half-wave rectification.

4. The speech compression apparatus of claim 1, wherein, to compensate for energy reduction of the signals input to the first peak detector and the second peak detector due to a removal from the input signal of samples that do not have peak values, the first peak detector adds values obtained by multiplying the amplitude of the removed samples by a specified gain to the peak values detected from the input signal and outputs the added values as the first peak signal the second peak detector adds values obtained by multiplying the amplitude of the removed samples by the specified gain to the peak values detected from the input signal and outputs the added values as the second peak signal.

5. The speech compression apparatus of claim 1, wherein the first masking unit and the second masking unit multiply samples removed in the masking by a specified gain and add the result of the multiplying to the samples that are not removed in the masking to obtain the first and second masked signals, respectively, to compensate for energy reduction of the signals input to the first masking unit and second masking unit due to the masking of the input signals.

6. The speech compression apparatus of claim 1, wherein the first specified frequency band is determined by a center frequency.

7. The speech compression apparatus of claim 6, when the high-band speech signal is a signal with a frequency above 2600 Hz and the narrowband low-band signal processed by the narrowband speech compressor is a signal with a frequency below 3700 Hz, the filter bank operates using two frequency bands whose center frequency are 2900 Hz and 3400 Hz, respectively.

8. The speech compression apparatus of claim 7, the first filter bank is a Gammatone filter bank.

9. A speech decompression apparatus that decompresses a speech signal that is compressed into a scalable bandwidth structure, comprising:

a narrowband speech decompressor receiving a low-band speech packet, decompressing the low-band speech packet, and outputting a decompressed narrow low-band speech signal;

a high-band speech decompression unit receiving a high-band speech packet, decompressing the high-band speech packet, and outputting a decompressed high-band speech signal; and an adder adding the decompressed narrow low-band speech signal and the decompressed high-band speech signal and outputting a result of the adding as a decompressed wideband speech signal, wherein the high-band speech packet includes a quantized RMS value, a predictor type index used when the speech signal is compressed, and a quantized DFT coefficient, and the high-band speech decompression unit self-calculates and uses a DFT coefficient phase when the quantized DET coefficient is an inverse DFT, and wherein the DFT coefficient phase is obtained for each DFT coefficient as follows:

$$\nu_i^{(0)}[m]=\nu_i^{(-1)}[m]+w_c N,$$

$$\theta_i[m]=\nu_i^{(0)}[m]+\Psi[m]$$

where $\theta_i[m]$ is the DFT coefficient phase, m is an index of the quantized DFT coefficient, i is a frequency band index, and $\nu_i^{(0)}[m]$ and $\nu_i^{(-1)}[m]$ correspond to a current subframe and a previous subframe, respectively.

10. A speech decompression apparatus that decompresses a speech signal that is compressed into a scalable bandwidth structure, comprising:

a narrowband speech decompressor receiving a low-band speech packet, decompressing the low-band speech packet, and outputting a decompressed narrow low-band speech signal;

a high-band speech decompression unit receiving a high-band speech packet, decompressing the high-band speech packet, and outputting a decompressed high-band speech signal; and an adder adding the decompressed narrow low-band speech signal and the decompressed high-band speech signal and outputting a result of the adding as a decompressed wideband speech signal, wherein the high-band speech packet includes an index of a quantized RMS value, a predictor type index used when the speech signal is compressed, and an index of a quantized DFT coefficient, and wherein the high-band speech decompression unit includes:

an inverse quantizer selecting an inverse quantizer from among a plurality of inverse quantizers using the predictor type index and calculating a quantized prediction error value using the selected inverse quantizer and the index of the quantized RMS value;

a prediction selector selecting a predictor from among a plurality of predictors in response to the predictor type index and calculating a quantized RMS value that corresponds to the quantized predictor error value using the selected predictor;

a codebook outputting a normalized DFT coefficient magnitude that corresponds to the index of the quantized DFT coefficient;

a multiplier multiplying the quantized RMS value by the normalized OFT coefficient magnitude;

a DFT phase calculator calculating a DFT coefficient phase corresponding to the index of the quantized DFT coefficient;

a inverse DFT unit obtaining a time domain signal for each of the frequency bands using the DFT coefficient magnitude output from the multiplier and the DFT coefficient phase output from the OFT phase calculator;

a filter bank obtaining a speech signal for each of the frequency bands using the time domain signal and outputting the speech signal; and an adder adding the speech signals for each of the frequency bands and outputting a result of the adding as a decompressed high-band speech signal that corresponds to the compressed high-band speech packet.

11. A speech compression apparatus comprising:

a first band-transform unit transforming a wideband speech signal to a narrowband low-band speech signal;

a narrowband speech compressor compressing the narrowband low-band speech signal and outputting a result of the compressing as a low-band speech packet;

a decompression unit decompressing the low-band speech packet and obtaining a decompressed wideband low-band speech signal;

an error detection unit detecting an error signal that corresponds to a difference between the wideband speech signal and the decompressed wideband low-band speech signal; and a high-band speech compression unit compressing the error signal and a high-band speech signal of the wideband speech signal and outputting the result of the compressing as a high-band speech packet, wherein the error detection unit comprises:

a first filter bank filtering the wideband speech signal in a first specified frequency band and outputting a first filtered signal;

a first masking unit generating a first masked signal for the wideband speech signal derived from the first filtered signal;

a second filter bank filtering the decompressed wideband low-band speech signal in a second specified frequency band and outputting a second filtered signal;

a second masking unit generating a second masked signal for the decompressed wideband low-band speech signal derived from the second filtered signal; and an inter-signal masking unit performing inter-signal masking on the first and second masked signals.

12. The speech compression apparatus of claim 11, wherein the inter-signal masking unit obtains a masking curve using the second masked signal and removes samples below the masking curve among samples included in the first masked signal.

* * * * *

UNITED STATES PATENT AND TRADEMARK OFFICE

CERTIFICATE OF CORRECTION

PATENT NO. : 7,624,022 B2
APPLICATION NO. : 10/882339
DATED : November 24, 2009
INVENTOR(S) : Chang-yong Son et al.

It is certified that error appears in the above-identified patent and that said Letters Patent is hereby corrected as shown below:

Column 16, Line 10, change "DET" to --DFT--.

Column 16, Line 57, change "OFT" to --DFT--.

Column 16, Line 64, change "OFT" to --DFT--.

Signed and Sealed this

Ninth Day of February, 2010

David J. Kappos

David J. Kappos
*Director of the United States Patent and Trademark Office*